United States Patent [19]

Claar et al.

[11] Patent Number: 5,045,657

[45] Date of Patent: Sep. 3, 1991

[54] ACTUATING DEVICE FOR THE MECHANICAL POSITIVE ACTUATION OF A PRESSURE-RESPONSE SWITCH

[75] Inventors: Klaus Claar, Gechingen; Jürgen Schrader, Stuttgart; Josef Berger, Wolfschlugen, all of Fed. Rep. of Germany

[73] Assignee: Daimler-Benz AG, Stuttgart, Fed. Rep. of Germany

[21] Appl. No.: 478,833

[22] Filed: Feb. 8, 1990

[30] Foreign Application Priority Data

Feb. 23, 1989 [DE] Fed. Rep. of Germany ..... 3905543

[51] Int. Cl.[5] ..... H01H 3/42

[52] U.S. Cl. ..... 200/332.1; 200/332

[58] Field of Search ..... 200/332.1, 332, 337, 200/573

[56] References Cited

U.S. PATENT DOCUMENTS 2,427,792 9/1947 Lear ..... 200/573

3,340,375 9/1967 Kiesel et al. ..... 200/332.1

FOREIGN PATENT DOCUMENTS 3406116 8/1985 Fed. Rep. of Germany .

*Primary Examiner*—Renee S. Luebke

*Attorney, Agent, or Firm*—Evenson, Wands, Edwards, Lenahan & McKeown

[57] ABSTRACT

An actuating device for the mechanical positive actuation of a pressure-responsive switch utilizes a pivotably movable spring-loaded switch lever which, when activated by a control component movable in relation to the switch, is pivotable out of a lift-off position separate from the switch into a switch-triggering position bearing on the switch which is thereafter maintained in the bearing position. The switch lever is motionally coupled to the control component by spring force until the switch-triggering position is reached. It is possible to trigger the switch at an exact point, the switch lever is made bend-resistant and is pivotable about a joint and spring-loaded in the direction of its switch-triggering actuating advance. Since the switch lever is maintained in its switch-triggering position by the spring force, the control component can be moved further, uncoupled from the switch lever, after the latter has reached the switch-triggering position and moved through an additional angle to effect an additional mechanical function.

10 Claims, 1 Drawing Sheet

ACTUATING DEVICE FOR THE MECHANICAL POSITIVE ACTUATION OF A PRESSURE-RESPONSE SWITCH

BACKGROUND AND SUMMARY OF THE INVENTION

The present invention generally relates to an actuating device for a mechanical positive actuation of a pressure-response switch, and more particularly, to such an actuating device for guaranting a reliable switch triggering at an exact point during the triggering operation.

An actuating device is disclosed, for example, in German Published, Unexamined Patent Application (DE-OS) 3,406,116, and consists of a so-called switch lug which is loaded mechanically by a control component of a rotary-latch lock. By means of this arrangement, it is possible to actuate an associated pressure switch activating an electromotive drive for a rotary latch of the lock.

In the foregoing actuating device, the switch lug is connected in a conventional way to a housing of a pressure switch, to form a constructional unit. The switch lug is made of a leaf spring equipped with a tracer roller at a free end thereof and is prestressed in the direction of its lift-off advance. The tracer roller of the switch lug thereby bears constantly with a corresponding prestress against the circumference of an associated control cam. Thus, depending on the rotary position of the control cam, the switch lug is maintained in a slightly compressed lift-off position relative to a switch pin of the pressure switch or in a more strongly compressed position bearing on the switch. In the latter position, the switch pin is pressed down into its switch-triggering position as a result of a bending advance of the switch lug.

A problem in the positive actuation of switches such switch lugs as described is above that the switch lugs do not bend identically during every switching actuation. On the contrary, because of other influencing factors, such as the vibrational load exerted on the switch arrangement at the switching time or differing speeds of the control advance exerted on the tracer roller, there is a slight deviation from the intended ideal bending line of the switch lug. Thus, even if the bending of the switch lug is purely elastic, it is impossible to select an exact switch point mechanically.

Furthermore, especially where switches employed under rough conditions of use are concerned, overelongation of the sensitive switch lugs can occur relatively easily and this can result in extreme deviations of the switch point from the desired value.

Moreover, the principle of switch actuation by means of a switch lug presupposes that there is a control component which can transmit a control advance to the switch lug which is matched to the switching advance of the switch lug.

As a result, the constructive possibilities in the arrangement of the switch or the design of the control component are considerably restricted.

An object of the present invention is, therefore, to improve an actuating device for the mechanical positive actuation of a pressure responsive switch, to the effect that, while greater constructive design freedom is ensured, a reliable switch triggering at an exact point during the switching operation can be guaranteed.

The solution, according to advantageous embodiments of the present invention, for achieving this object and other objects arises from a bend-resistant switch lever being appropriately lengthenable to matching a control advance of a control component which is markedly larger in comparison with a switching advance of a switch pin. As a result, movable levers or the like present in any case can more easily be used additionally as a control component for switch activation.

Other objects, advantages and novel features of the present invention will become apparent from the following detailed description of the invention when considered in conjunction with the accompanying drawings.

DETAILED DESCRIPTION OF THE DRAWINGS

Figure 1:
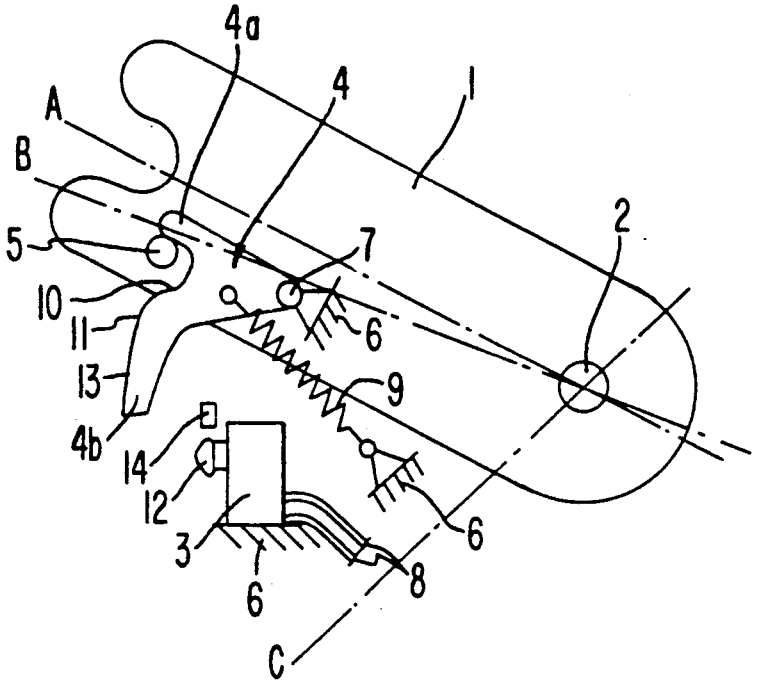
FIG. 1 shows an arrangement of a switch lever on a rotary-latch lock according to one embodiment of the present invention, with the switch lever lifted off a switch to be activated at a precise point during the movement of the rotary-latch lock.

A control component in the form of rotary latch 1 of a motor-vehicle lock, not shown in detail, is mounted on a lock plate, shown as the drawing background, by means of a pivot axle 2 mounted fixedly on the lock plate. In order to permit a lid, mounted about a horizontal Pivot axis, to be locked fixedly by the rotary latch 1 relative to the vehicle body, the rotary latch 1 is pivotable out of an obliquely upwardly directed opening position A, in which a locking eye of the lid can be swung into a fork aperture therefor, and into an obliquely downwardly directed closing position C, in which the locking eye is held down by the rotary latch 1 which is blocked against pivoting by a detent device.

To open the lid, the motor-vehicle lock is released via an actuating member whereby the pivot-blocking of the rotary latch 1 is cancelled. The rotary latch 1, once released, snaps back under a spring load into the opening position A, in which it is held against a stop and is thus fixed. The locking eye is thus freed and the lid can be lifted open.

Figure 2:
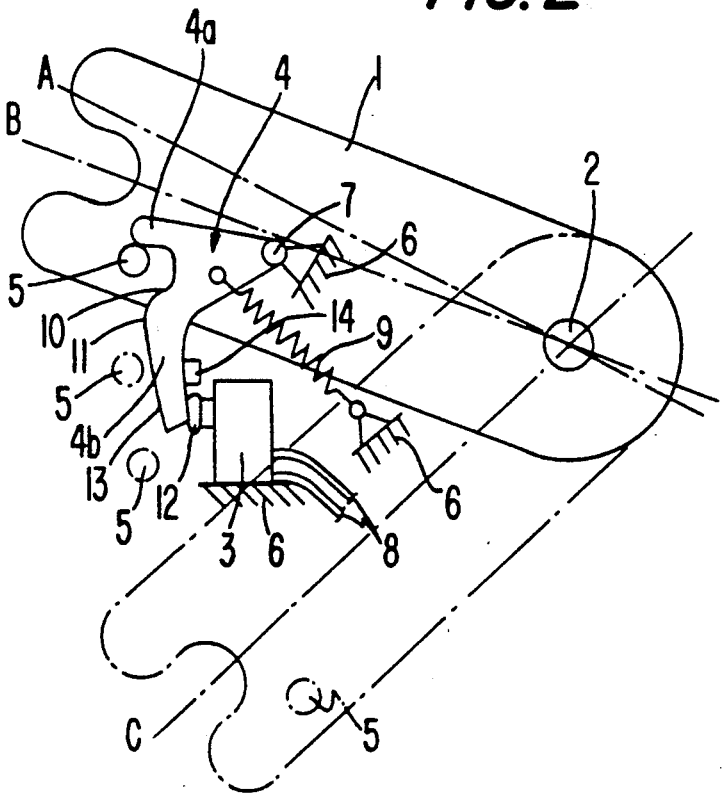
FIG. 2 shows the arrangement according to FIG. 1, with the switch lever positively actuated.

Between the opening position A and the closing position C, as seen in FIG. 2, the rotary latch 1 is pivotable through an angle of approximately 70°, each actuating cycle comprising a closing movement and an opening movement through this angle.

During each actuating cycle of the rotary latch 1, a microswitch 3, a switching signal generated thereby being processed by an electronic control unit, is actuated at a specific rotary position of the rotary latch 1 during a closing advance thereof. The actuation of the switch 3 will thus occur exactly at a switch position B of the rotary latch 1, as seen in FIG. 2, in which the locking eye of the lid is just blocked against swinging out from the fork aperture of the rotary latch 1. Furthermore, the microswitch 3 will remain closed until the switch position B of the rotary latch 1 is reached again in the course of an opening advance thereof, and will thereafter be opened and remain open until the next positive actuation cycle.

For this purpose, the microswitch 3, a switch lever 4 and a take-up pin 5 are arranged next to the rotary latch 1 in a plane parallel to the pivoting plane of the latche. The preferably cylindrical take-up pin 5 is connected fixedly to the rotary latch 1 and projects substantially perpendicularly from a wide side thereof in the region located near its fork aperture. In contrast to this, the microswitch 3 and the switch lever 4 are arranged on a common lock plate 6 which extends a surface of parallel to the lock plate formed by the drawing background and which is indicated merely in hatch line at certain points for the sake of clarity.

The switch lever 4 is fastened pivotably to the lock Plate 6 via a bearing axle 7 which projects from the axle transversely relative to a plane of the lock-Plate 6. In contrast, the microswitch 3, connected to the electronic control unit via cables 8, is fastened, for example, by screws or the like, to the lock plate 6 separately from the switch lever 4. Arranging the bearing axle 7 separately from the microswitch 3 in spatial terms affords maximum freedom for the design of the switch lever 4.

The bearing axle 7 is located, offset radially relative to the pivot axle 2, between the pivot axle 2 and a circular path along which the take-up pin 5 moves in the course of an actuation of the rotary latch 1. As seen in FIG. 1, in the opening position A of the rotary latch 1, the bearing axle 7 lies on a joining line between the pivot axle 2 and the take-up pin 5. The switch lever 4 has two lever arms, a catching arm 4*a* for interacting with the take-up pin 5, and a striking arm 4*b* for subjecting the microswitch 3 to pressure.

In order to obtain a motional coupling of the rotary latch 1 and the lever 4, mounted in a rocker-like manner, when the microswitch 3 is not actuated, the catching arm 4*a* extends radially outwards, starting from the bearing axle 7, and thereby passes, with an end region, completely through the circular path surface covered by the take-up pin 5 during an actuation of the rotary latch 1. Moreover, the switch lever 4 is loaded by a helical tension spring 9, a line of action of which, determined by its points of suspension of the switch lever 4 and on the lock plate 6, extends between the bearing axle 7 and the microswitch 3. As a result of this spring load, effective in the anticlockwise direction, between two switch actuations, the catching arm 4*a* bears with an edge against the circumference of the take-up pin 5.

In order to ensure that the switch lever 4 is pivoted into its switch-triggering position, even when its mounting on the bearing axle 7 jams, the striking arm 4*b*, starting from the bearing axle 7, extends first at an acute angle to the catching arm 4*a* so as to radially extend into at least a portion of the circular path of the take-up pin 5. However, in contrast to the catching arm 4*a*, the radial extension of the striking arm 4*b*, into the circular path of the take-up pin 5, terminates early in the middle of the circular path surface. The radial length portion of the striking arm 4*b* merges into a tangential length portion thereof which extends downwards in the plane of the switch lever 4.

In the opening position A of the rotary latch 1, the switch lever 4, therefore, engages the take-up pin 5 in a fork-like manner in a lift off position. Thus, if the switch lever 4 remains in the position shown in FIG. 1, despite the fact that the take-up pin 5 is moving downwards, the take-up pin 5 abuts a stop edge 10 of the striking arm 4*b* and thereby transmits a pivoting impetus to the switch lever 4. At the same time, the clear width between the catching arm 4*a* and the stop edge 10 should be preferably calculated markedly larger than the diameter of the take-up pin 5, so that a powerful impact can effect a breaking-loose in the event of jamming of the lever 4.

Preferably, the stop edge 10 merges into a guide edge 11 of the tangential length portion of the striking arm 4*b* which extends over a part length of the latter.

This guide edge 11 has a curvature which corresponds substantially to the curvature of the circular path of the take-up pin 5. After the conclusion of the switch-triggering pivoting advance of the switch lever 4, the guide edge 11 lies in exact alignment along an inner limiting line of the circular path surface covered by the take-up pin 5 as shown in FIG. 2 so that the take-up pin 5 can move past the switch lever 4 as the closing position C is approached.

To ensure that the switch-triggering pivoting advance of the switch lever 4 is also concluded at this position shown in FIG. 2, the microswitch 3 is arranged behind the tangential length portion of the striking arm 4*b* so that its rear edge presses a switch pin 12 of the microswitch 3 down into its switching position. Thus, even if the mounting of the switch lever 4 is jammed tenaciously, a mechanical positive actuation of the microswitch 3 via the take-up pin 5 still takes place.

In order to ensure that the take-up pin 5 is uncoupled from the switch lever 4 as early as possible, the guide edge 11 is made relatively short and merges into a setback run-off edge 13 towards the free end of the striking arm 4*b*.

To ensure that, when the microswitch 3 is closed, no unnecessary additional forces have to be absorbed between the switch pin 12 and the rear edge of the striking arm 4*b* exerting stress on the latter, a blocking stop 14, against which the rear edge of the striking arm 4*b* likewise bears, is for example, mounted on the lock plate 6.

As a result of the above-described arrangement and design of the constructional elements, the following control actions occur in the course of an actuating cycle of the rotary latch 1.

In the operation of closing the rotary latch 1, the take-up pin 5 is moved on a downwardly directed circular path about the pivot axle 2 out of the opening position A to the closing position C Since the switch lever 4 is subjected to pivoting stress as a result of the tension of the helical tension spring 9, an edge of the catching arm 4*a* first bears, under the spring prestress, against the circumference of the take-up pin 5 and is maintained in a bearing position until the switch position B is reached, thus guaranteeing a synchronous movement.

At the same time, the compensation in pivoting length between the rotary latch 1 and the switch lever 4 is obtained by the sliding of the take-up pin 5 along on that edge of the catching arm 4*a* bearing on it. Shortly before the switch position B is reached, the rear edge of the striking arm 4*b* comes up against the switch pin 12 of the microswitch 3 and, in the last phase of the pivoting advance of the switch lever 4, presses the switch pin 12 down into its switch-triggering position. In this pressed-down switch position B, the switch lever 4 is fixed, since it is pulled up against a blocking stop 14 by a residual compression prestress of the helical tension spring 9.

During the further pivoting of the rotary latch 1 out of the switch position B shown in FIG. 2, an automatic uncoupling of the rotary latch 1 from the switch lever 4 takes place because, as represented by broken lines, the take-up pin 5 moves further downwards on its circular path. Thus, in the closing position C, there is a complete uncoupling of the switch lever 4 from the rotary latch 1, so that mechanical vibrations of the rotary latch 1 cannot exert any direct influence on the microswitch 3.

In the opening of the rotary-latch lock, the rotary latch 1 snaps out of the closing position C into the opening position A under a spring load, the take-up pin 5 describing an identical circular path, but in the opposite direction to the closing operation. When the switch position B is passed, the take-up pin 5 comes up against the edge of the catching arm 4*a* and takes up the switch lever 4, the latter being pivoted into its lift-off position according to FIG. 1. An extension of the helical tension spring 9 consequently occurs, in which the spring energy is therefore stored for a subsequent Positive actuation. Since the spring force on the rotary latch 1 amounts to a multiple of the spring force of the helical tension spring 9, the action of snapping the rotary latch 1 into its opening position is not impaired thereby.

In a first phase of the operation of lifting off the striking arm 4*b* from the switch pin 12, the latter resumes its initial pushed-out position by means of a return spring, with the result that the microswitch 3 is opened.

The microswitch 3 remains in its open position until its next mechanical positive actuation, since the switch lever 4 is motionally coupled to the take-up pin 5 again.

So that the production tolerances of the constructional elements involved can be relatively large, it is expedient to mount the microswitch 3 and/or the blocking stop 14 and/or the bearing axle 7 adjustably on the lock plate 6. The desired switch point can be set exactly by shifting these constructional elements in relation to one another.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. An actuating device for a mechanical positive actuation of a pressure-response switch, comprising a control component movable in relation to the switch to effect an additional mechanical function, a pivotably movable, spring-loaded switch lever actuatable by movement of the control component in the same rotation direction and pivotable out of a lift-off position separate from the switch into a switch-triggering position bearing on the switch and thereafter maintained in the switch triggering position, and a spring motionally coupling the. switch lever to the control component until the switch-triggering position is reached, the switch lever being pivotable about a joint and the spring loading the switch lever in a direction of switch-triggering actuating advance, wherein the control component is configured to be uncoupled from the switch lever and further movable after the switch-triggering position of the switch lever has been reached and the switch lever is maintained in the switch-triggering position by the spring and wherein the control component is pivotable between two end positions for effecting the mechanical function during an actuating cycle such that the switch is positively actuated during an advance of the pivoting control component over a substantially smaller pivoting angle than is defined by the two end positions in one direction of movement from one of the two end positions to the other of the two end positions, and in the course of a pivoting advance in another direction of movement, the switch lever is taken up by the pivoting control component into the lift-off position, with the spring having energy stored for a next positive actuation of the switch.

2. An actuating device according to claim 1, wherein the switch-triggering actuating advance of the switch lever is limited by a blocking stop.

3. An actuating device according to claim 1, wherein the spring for the spring-loading of the switch lever is a helical spring.

4. An actuating device according to claim 1, wherein the switch lever is mounted at a distance from the switch, and wherein the switch lever has a rocker-like mounting and two lever arms, one of the lever arms being a striking arm for striking against the switch, and an other lever arm being a catching arm for a take-up device of the pivoting component.

5. An actuating device according to claim 4, wherein the switch lever is pivotable in a plane virtually parallel to a pivot plane of the pivoting component, wherein the take-up device is a take-up pin projecting substantially transversely from the pivoting component, and wherein the switch lever, controlled to lift off after the take-up pin has come up against the catching arm, is supported by the take-up pin until the switch-triggering position of the pivoting component is reached

6. An actuating device according to claim 5, wherein the switch lever is pivotable about a bearing axle which is arranged offset in a direction of the pivot axle of the pivoting component, as seen from a path of movement of the take-up pin.

7. An actuating device according to claim 6, wherein, with the switch open, the striking arm projects into the path of movement of the take-up pin, and wherein, with the switch closed, the striking arm is located outside the path of movement.

8. An actuating device according to claim 7, wherein the lever arms of the switch lever extend in an approximately V-shaped manner in relation to one another, and wherein the lever arms engage around the take-up pin in a fork-like manner, the path of movement of the take-up pin having an end region of the catching arm passing therethrough along substantially an entire length of the path and a portion of the striking arm Passing therethrough along a partial length thereof.

9. An actuating device according to claim 8, wherein the striking arm has one portion projecting into the path of movement of the take-up pin and another portion tangetially extending from the one portion projecting into the path of movement of the take-up pin, to the path of movement.

10. An actuating device according to claim 9, wherein a stop edge of the striking arm confronting the take-up pin merges into a guide edge of the striking arm which is curved essentially parallel to the path of movement of the take-up pin.

* * * * *